US008156712B2

(12) United States Patent
Kopshever, Sr.

(10) Patent No.: US 8,156,712 B2
(45) **Date of Patent: *Apr. 17, 2012**

(54) TOWER REINFORCEMENT APPARATUS AND METHOD

(75) Inventor: Michael J. Kopshever, Sr., Newburgh, IN (US)

(73) Assignee: Tower Reinforcement, Inc., Newburgh, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/228,355

(22) Filed: Sep. 8, 2011

(65) Prior Publication Data

US 2011/0314770 A1 Dec. 29, 2011

Related U.S. Application Data

(63) Continuation of application No. 12/900,225, filed on Oct. 7, 2010, now Pat. No. 8,046,972, which is a continuation of application No. 11/159,689, filed on Jun. 23, 2005, now Pat. No. 7,849,659.

(60) Provisional application No. 60/582,160, filed on Jun. 24, 2004.

(51) Int. Cl.
*E04C 3/00* (2006.01)

(52) U.S. Cl. ..... 52/849; 52/848

(58) Field of Classification Search ..... 52/40, 736.2, 52/745.17, 745.18, 834, 848, 849; 343/874, 343/875, 878, 890–892; 403/286, 293, 294
See application file for complete search history.

(56) References Cited

U.S. PATENT DOCUMENTS

| | | | | |
|---|---|---|---|---|
| 1,420,430 | A | 6/1922 | Jaeckle et al. | |
| 2,090,972 | A | 8/1937 | Allen | 52/170 |
| 2,327,681 | A | 8/1943 | Vanderveer | 52/835 |
| 2,401,799 | A | 6/1946 | Riemenschneider et al. | 52/148 |
| 3,201,834 | A * | 8/1965 | Baittinger | 403/312 |
| 4,032,244 | A * | 6/1977 | Quayle | 403/286 |
| 4,097,165 | A * | 6/1978 | Quayle | 403/286 |
| 4,248,025 | A | 2/1981 | Kleine et al. | 52/845 |
| 4,500,064 | A | 2/1985 | Calabro | 248/539 |
| 4,934,114 | A * | 6/1990 | Lindsey | 52/40 |
| 5,749,198 | A * | 5/1998 | Johnson | 52/651.04 |
| 6,108,996 | A | 8/2000 | McGinnis | 52/651.02 |
| 6,532,711 | B2 | 3/2003 | Gregel | 52/583.1 |
| 6,561,736 | B1 | 5/2003 | Doleshal | 405/251 |
| 6,694,698 | B2 | 2/2004 | Ryan | 52/41.1 |
| 6,901,717 | B2 | 6/2005 | Brunozzi et al. | 52/834 |
| 6,957,518 | B1 * | 10/2005 | Koch, Jr. | 52/849 |
| 7,116,282 | B2 * | 10/2006 | Trankina | 52/845 |
| 8,046,972 | B2 | 11/2011 | Kopshever, Sr. | |
| 2003/0010426 | A1 | 1/2003 | Lockwood | 156/187 |
| 2004/0134161 | A1 * | 7/2004 | Lockwood et al. | 52/736.1 |
| 2004/0139665 | A1 | 7/2004 | Ulrich et al. | 52/169.9 |
| 2008/0250752 | A1 | 10/2008 | Bowman et al. | 52/848 |
| 2009/0016897 | A1 | 1/2009 | Olgaard | 416/244 |

* cited by examiner

*Primary Examiner* — Brian Glessner
*Assistant Examiner* — Adriana Figueroa
(74) *Attorney, Agent, or Firm* — Fish & Richardson P.C.

(57) ABSTRACT

A method and apparatus for creating a reinforced vertical multi-sided monopole tower for supporting equipment including a multi-sided monopole, a plurality of holes on three equally spaced sides of the multi-sided monopole tower and tower reinforcement apparatus mounted to the holes. The tower reinforcement apparatus includes bolts supporting a first flat bar and a second flat bar on each side of the tower. The upper end of the first flat bar abuts a lower end of the second bar and a plate is bolted over adjacent ends connecting the first and second flat bar such that the first and second flat bars are sandwiched between the plate and a side of the perimeter of the monopole.

19 Claims, 4 Drawing Sheets

TOWER REINFORCEMENT APPARATUS AND METHOD

CROSS-REFERENCE TO RELATED APPLICATIONS

This application is a continuation application of and claims priority to U.S. application Ser. No. 12/900,225, filed on Oct. 7, 2010, which is a continuation of U.S. application Ser. No. 11/159,689, filed on Jun. 23, 2005, which is a utility conversion of Provisional Application Ser. No. 60/582,160, filed on Jun. 24, 2004. The disclosures of U.S. application Ser. Nos. 12/900,225 and 11/159,689 and U.S. Provisional Patent Application No. 60/582,160 are incorporated herein by reference in their entirety.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This present invention relates to a means of increasing the load capacity of a monopole tower and in particular, an apparatus and method for increasing the load capacity and stability of the tower to support the weight of additional communication equipment as well as the environmental forces exerted on the tower.

2. Brief Description of Prior Art

Single-pole towers, also referred to as monopole towers are used in the telecommunications industry. In particular, such towers are used to support equipment for wireless phones and other communication devices.

The increase in wireless communications has resulted in an increase of mounted communication equipment of all kinds. Not only do wireless service providers need to install equipment covering new geographic areas, competing wireless service providers need to install additional equipment covering the same or similar geographic areas. The solution to the foregoing problem is to either purchase additional land to erect new towers, or install additional equipment on existing towers. Purchasing land to install additional towers is increasingly expensive, as well as the expense associated with the construction and the maintenance of a new tower.

Towers are designed generally to support the weight of the communications equipment originally installed on the tower, as well as to withstand forces exerted on the tower by environmental factors, such as wind and ice, for example. Towers are generally not designed with sufficient stability to enable the tower to allow for the installation of additional equipment. As a result, prior art methods of increasing the stability of the tower in order to support additional equipment are known to consist basically of familiar, expected and obvious structural configurations, typically reinforcing the weak area of the tower (the area where the additional equipment is to be installed) by means of a weld repair, such as an overlay of welding material. Installing the welding material can be done manually, or by using an automatic welding machine.

Therefore, it can be appreciated that there exists a continuing need for an apparatus and method for increasing the load capacity and stability of a tower to enable the tower to support the weight of additional communication equipment as well as the environmental forces exerted on the tower.

As will be seen from the subsequent description, the preferred embodiments of the present invention overcome limitations of monopole tower arrangements.

SUMMARY OF THE INVENTION

With the proliferation of cell phones and personal communications devices comes the need for towers to support additional equipment for wireless phone and other communication devices. The present invention is designed to increase the load capacity and stability of a tower to enable the tower to support the weight of additional communication equipment as well as the environmental forces exerted on the tower. The preferred embodiment generally includes vertical flat bars disposed about the tower and mounted to the tower with one-sided bolts. A joining plate is further disclosed when joining a first vertical flat bar with a second vertical flat bar.

The presence of the tower support elements of the present invention increases the load capacity and stability of the tower. Specifically, the vertical flat bars provide reinforcement to the tower to allow for the installation of additional equipment.

DESCRIPTION OF THE PREFERRED EMBODIMENTS

FIGS. 1-6 illustrate a preferred embodiment of a tower reinforcement apparatus 1 made in accordance with the present invention. In the preferred embodiment, the tower reinforcement apparatus 1 is attached to a prior art monopole tower 100 at selected locations to maximize the strength of the tower 100 and reinforce the tower 100 in order to enable the tower 100 to support the weight of additional communication equipment (not shown) as well as the environmental forces exerted on the tower 100.

The prior art monopole tower 100 is generally attached to a base flange 110 and is comprised of a solid sheet of formed metal that forms a structure capable of supporting the various communication equipment that may be attached to the prior art tower 100.

In general, the prior art monopole tower 100 is designed to support the weight of the communications equipment originally installed on the tower 100, as well as to withstand forces exerted on the tower 100 by environmental factors, such as wind and ice, for example. The monopole towers of the prior art are generally not designed with sufficient stability to enable the tower 100 to allow for the installation of additional equipment. The tower reinforcement apparatus 1 is designed to attach to the prior art monopole tower 100 at selected locations where additional equipment will be installed in order to maximize the strength and provide reinforcement to the tower 100 at such selected locations.

Figure 4:
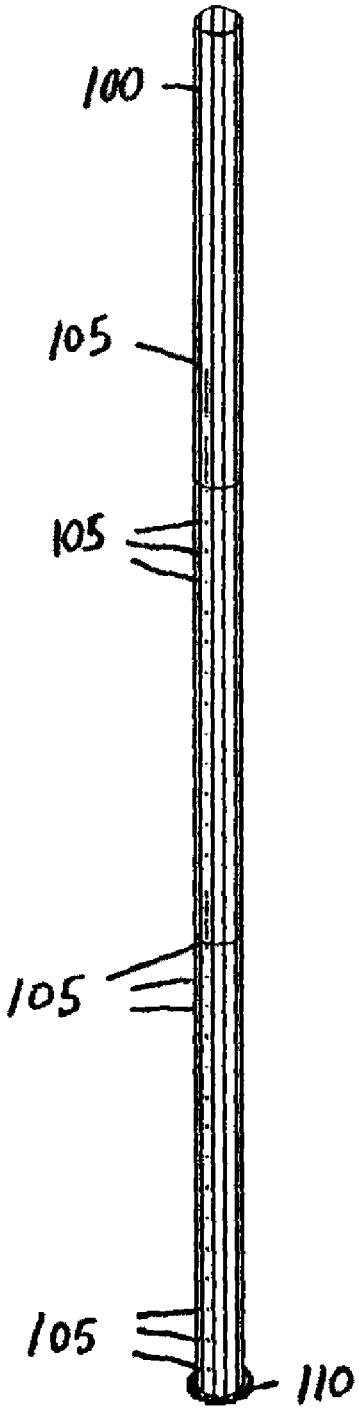
FIG. 4 is a perspective view of a monopole tower showing field drilled holes for receiving one-sided bolts.
Figure 5:
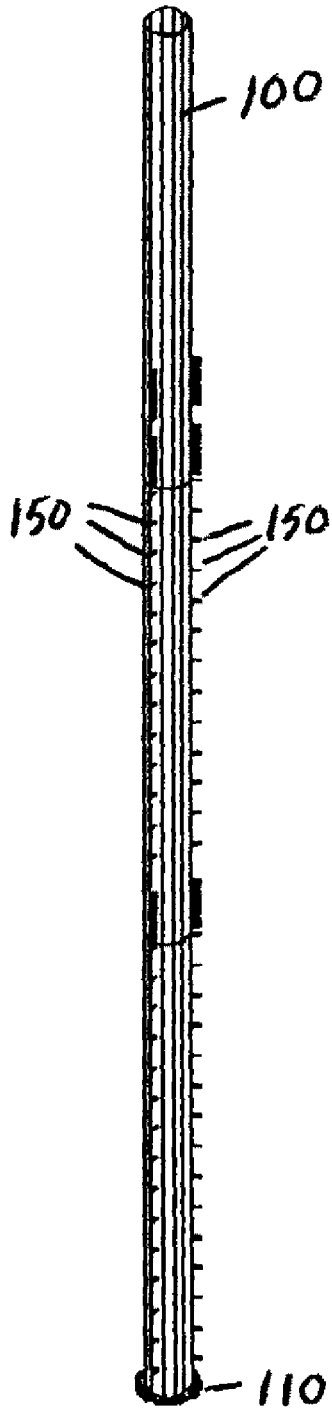
FIG. 5 is a perspective view of a monopole tower showing installed one-sided bolts.
Figure 6:
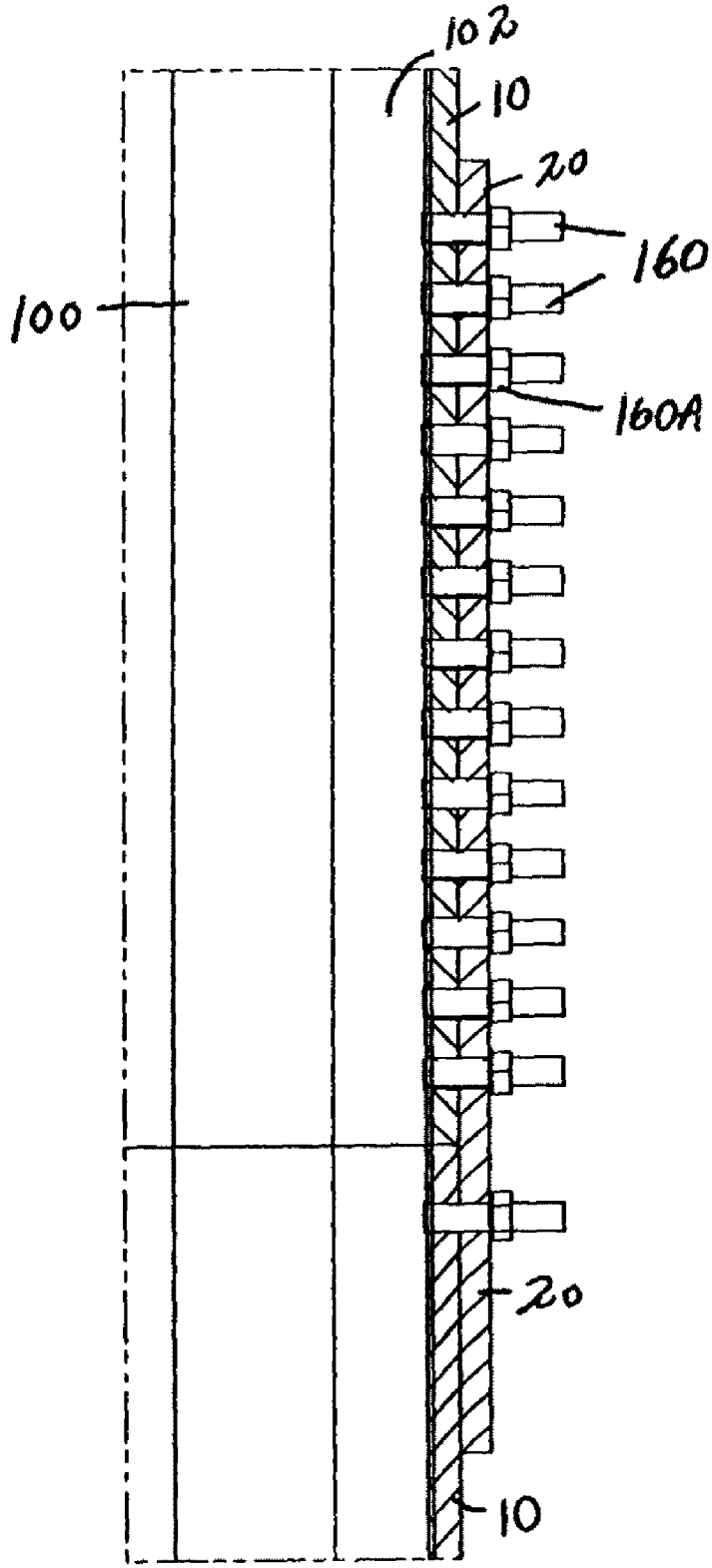
FIG. 6 is a cutaway detail view of the present invention showing one-sided bolts, the vertical flat bar, and the tower section.

In application, the tower 100 is drilled with a plurality of holes 105 at selected locations as shown in FIG. 4 for receipt of one-sided bolts 150 preferably one-sided stitch bolts 150 as shown in FIG. 5. A vertical flat bar 10 having a plurality of apertures 11 attaches to the prior art monopole tower 100 with the plurality of one-sided stitch bolts 150 and nuts 150A. The vertical flat bar 10 is attached to the tower 100 at selected locations in order to maximize the strength and provide reinforcement to the tower 100 at those selected locations. Further, the spacing of the bolts 150 along the vertical flat bar 10 can be considerably narrower to further increase the reinforcement. In the preferred embodiment, at least one one-sided termination bolt 155 and nut 155A (shown in FIG. 1B) is installed at the approximate top end of the flat bar 10 to further secure the vertical flat bat 10 to the tower 100.

As should be understood, the longer the vertical flat bar's 10 length, the more difficult the vertical flat bar 10 is to manage and handle when attaching the bar 10 to the tower 100 in the field. As such, when longer lengths of flat bar 10 is required, it is preferred to apply multiple vertical flat bars 10 to maximize the strength and provide reinforcement to the tower 100.

Figure 1A:
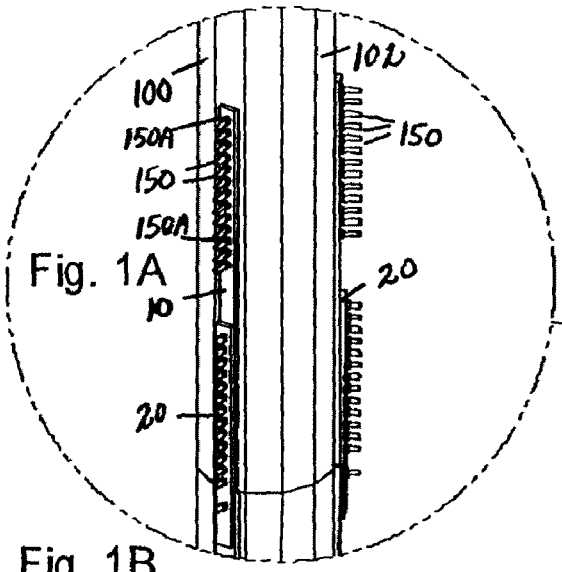
FIG. 1A is a detail view of bolt spacing for an end of a vertical flat bar and joining plate.
Figure 1B:
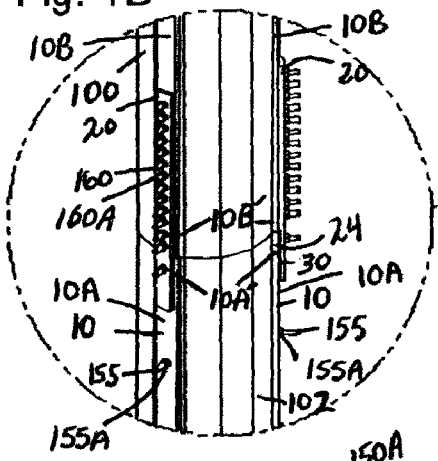
FIG. 1B is a detail view of a section of the apparatus of FIG. 1.
Figure 1:
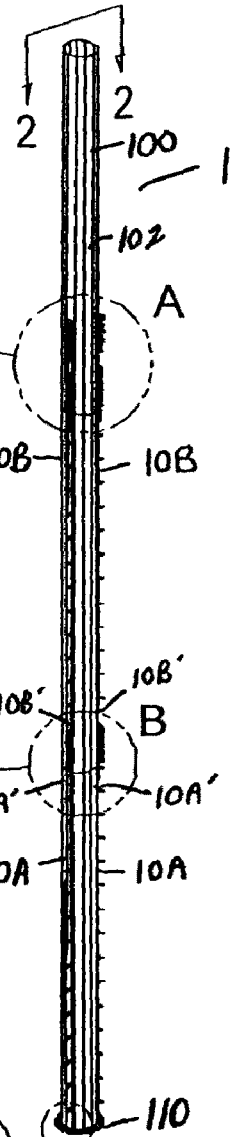
FIG. 1 is a perspective view of a preferred embodiment of the present invention, a reinforced tower.

As an example, and referring to FIGS. 1 and 1B, a first vertical flat bar designated in FIG. 1 as 10A is attached at its upper end to the tower 100 as discussed above, and a second vertical flat bar designated as 10B in FIG. 1 is attached to the tower 100 with an upper end 10A' of the first vertical flat bar 10A in abutting communication with a lower end 10B' of the second vertical flat bar 10B. A joining plate 20 having a plurality of apertures 21 is attached to the first and second flat bars 10A, 10B, respectively, where the ends 10A' 10B' abut. In this configuration, the ends 10A' 10B' of the first and second vertical flat bars 10A, 10B are sandwiched between the exterior surface 102 of the tower 100 and the joining plate 20. The joining plate 20 is attached to the tower 100 (with the flat plate bars sandwiched therebetween) using a plurality of bolts 160 preferably a plurality of one-sided splice plate bolts 160 and nuts 160A.

Referring to FIG. 1B, which shows attachment of abutting ends 10A' and 10B' and the joining plate 20, a spacing 24 can exist between the upper end 10A' of the first vertical flat bar 10A and the joining plate 20. This spacing 24 occurs due to the prior art monopole's 100 construction namely, the overlap of the monopole's 100 sections that form the monopole 100. When this occurs, a spacer plate 30 can be inserted within the spacing 24 between the outer surface of the vertical flat bar 10A and the joining plate 20 such that the attached joining plate 20 is attached to a substantially level solid surface.

Figure 1C:
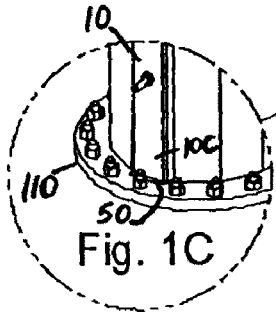
FIG. 1C is a detail view of a full penetration weld between the vertical flat bar and the base flange.

As best shown in FIG. 1C, the tower 100 is affixed to the base flange 110 with means known in the art. The vertical flat bar 10, when required, can be attached to the tower 100 so that a lower end designated as 10C in FIG. 1C is positioned adjacent, but not in abutting relationship with, the base flange 110. To further strengthen the tower reinforcement apparatus 1, a full penetration weld 50 is disposed between the end 10C of the vertical flat bar 10 and the base flange 110. It should be noted that for safety measures, and other concerns relating to welding to monopole towers, the only welding operation when attaching the tower reinforcement apparatus 1 of the present invention is the weld 50 between the lower end 10C of the vertical flat bar 10 and the base flange 110.

Figure 2:
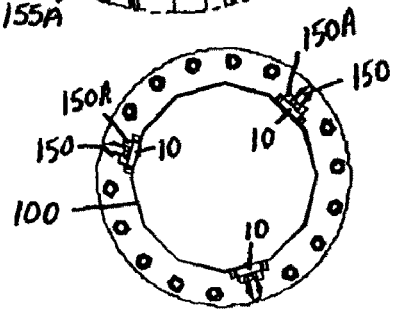
FIG. 2 is a top view of the tower reinforcement apparatus of FIG. 1, illustrating the preferred spacing between the vertical flat bars.

The vertical flat bar 10 is selectively positioned along the length of the tower 100 in order to add support to that area of the tower 100 where additional communication equipment is to be installed. As discussed, multiple vertical bars 10 are preferably joined with joining plates 20 to maximize the strength and provide reinforcement to the tower 100. In the preferred embodiment, a plurality of vertical flat bars 10 and joining plates 20 may be used in order to strengthen the approximate upper region of the tower 100 where added support is needed, as well as the approximate lower region of the tower 100 where added support is needed. Further, and as illustrated in FIG. 2, the preferred spacing between vertical flat bars 10 about the outer perimeter surface 102 of the tower 100 is approximately 120 degrees. As can be seen in cross-section FIG. 2, the monopole tower 100 is a 12 sided hollow column with each vertical flat bar 10 spaced 4 sides apart on one of the 12 flat sides of the tower 100.

By installing multiple vertical flat bars 10 as described above, shorter lengths of flat bars 10 may be used for easier field assembly. As a result, it is possible to attach communication equipment and/or other types of loads directly to the tower 100. Such loads may be attached to the tower 100 at any point along the vertical length of the installed tower reinforcement apparatus 1.

By installing the tower reinforcement apparatus 1 to the tower 100 as described above, bending moments experienced by the tower 100 may be passed into and absorbed by the tower reinforcement apparatus 1, thereby increasing the load capacity and stability of the tower 100 in order to enable the tower 100 to support the weight of additional communication equipment as well as the environmental forces exerted on the tower.

The tower reinforcement apparatus 1 may be installed on towers which are not yet installed or which is not vertical, or on previously installed towers.

Metal, such as steel or aluminum, is the preferred material of construction of the preferred embodiment of the vertical flat bars 10 and the joining plates 20.

The preferred bolts 150, 155 and 160 are known in the art. The size of the bolts 150, 155 and 160 and spacing of the bolts 150, 155 and 160 is determined by the amount of reinforcing required. Further, the extent of reinforcing also determines the size and length of the vertical flat bars 10. In the preferred embodiment, the vertical flat bars 10 are installed continuous up the length of the tower 100. Again, this is accomplished by installing the joining plate 20 to the ends of abutting vertical flat bars 10.

In operation, to reinforce an existing tower 100 to which additional equipment is to be added, a series of holes 105, as shown in FIG. 4 would be drilled along the length of at least one flat side of the tower 100. The placement and spacing of the holes 105 could be designed based on the added load of the additional equipment. Typically 3 flat sides, spaced at approximately 120 degree spacings around the tower, would each receive holes 105.

Figure 3:
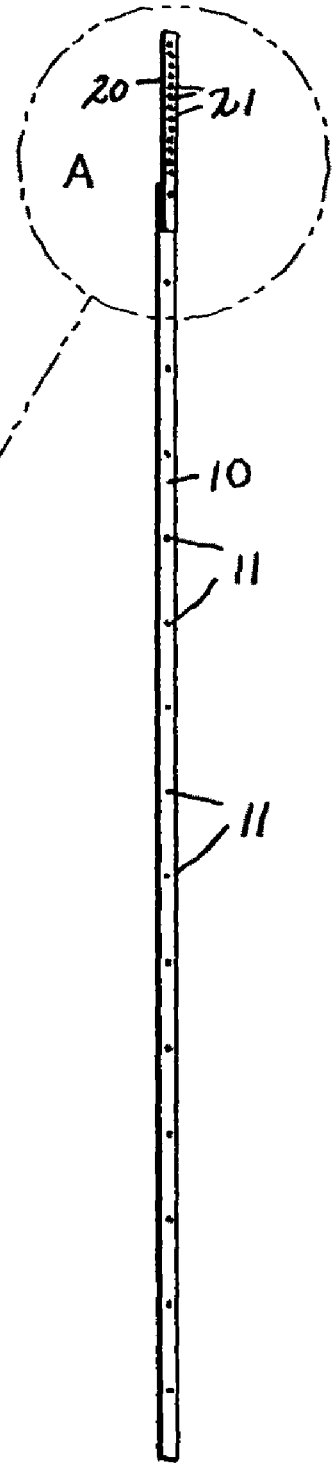
FIG. 3 is a perspective view of the vertical flat bar and joining plate.
Figure 3A:
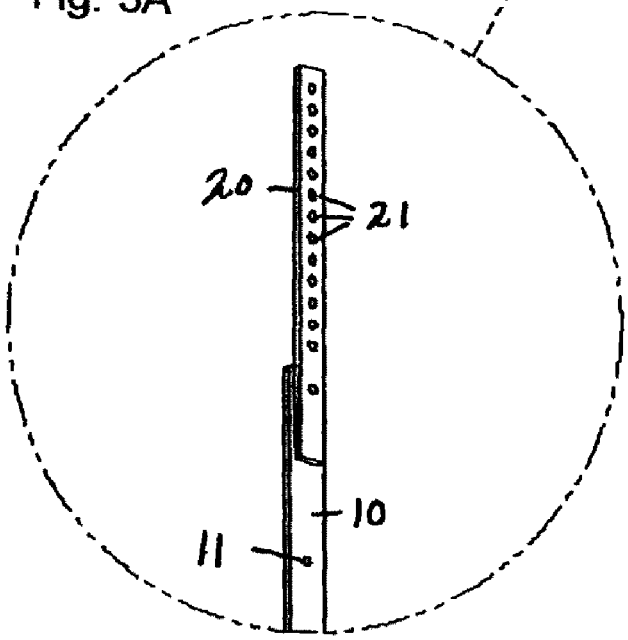
FIG. 3A is a detail view of an end of the vertical flat bar and joining plate.

With the holes 105 in place, flat bars 10 with clearances 11 matching the spacing of holes 105 are placed against each flat side of the perimeter 102 of the tower 100 and are bolted to the tower using bolts. All of the holes 105 and 11 can be pre-drilled prior to placing the flat bars 10 in place or some of the holes 11, 105 might be drilled after the flat bars are in place. Most towers 100 are tall enough to require multiple sections of flat bar 10. A first flat bar 10A is placed and then a second flat bar 10B is placed aligned with the first bar 10A and with ends 10A' and 10B' adjacent to each other forming a joint space. In these cases a plate 20 is placed over the joint space to support it. A series of holes 21 are drilled through the plate 20 and bolts 160 secure the plate 20 to the end of bars 10A and 10B. Again, holes 21 can be pre-drilled or drilled at the time of installation. As shown in FIG. 3, the plate 20 can be pre-attached to one of the flat bars 10A prior to installation. Once in place an end of the bottom most bar 10A is welded to a base flange 110 of the tower 100.

Although the description above contains many specificities, these should not be construed as limiting the scope of the invention but as merely providing illustrations of some of the presently preferred embodiments of this invention.

It will be obvious to those skilled in the art that modifications may be made to the embodiments described above without departing from the scope of the invention. Thus the scope of the invention should be determined by the claims in the formal application and their legal equivalence, rather than by the examples given.

I claim:

1. A reinforced vertical multi-sided monopole tower, comprising:

a monopole-type tower wall having a solid outer wall formed into at least one side;

the tower wall having an outer surface and an inner surface;

a first vertical reinforcing member having a first longitudinal side, a second longitudinal side and a first abutting surface between the first and second longitudinal sides, the first vertical reinforcing member bolted by a plurality of bolts to the outer surface of the at least one side of the monopole-type tower wall such that the first longitudinal side of the first vertical reinforcing member overlays a portion of the outer surface of the at least one side of the tower wall;

a second vertical reinforcing member having a first longitudinal side, a second longitudinal side, and a second abutting surface between the first and second longitudinal sides, the second vertical reinforcing member bolted by a plurality of bolts to the outer surface of the at least one side of the monopole-type tower wall such that the first longitudinal side of the second vertical reinforcing member overlays a portion of the outer surface of the at least one side of the tower wall, wherein the second vertical reinforcing member is vertically aligned with the first vertical reinforcing member such that the first abutting surface and the second abutting surface are adjacent;

a vertical joining plate bolted to the second longitudinal side of the first vertical reinforcing member or the second longitudinal side of the second vertical reinforcing member, wherein at least one bolt passes through the vertical joining plate and either the first vertical reinforcing member or the second vertical reinforcing member and into the at least one side of the monopole-type tower wall.

2. The apparatus of claim 1, wherein the first vertical reinforcing member further comprises a second abutting surface coupled to a base portion of the multi-sided monopole tower wherein the second abutting surface of the first vertical reinforcing member is between the first and second longitudinal sides and longitudinally opposite the first abutting surface of the first vertical reinforcing member.

3. The apparatus of claim 1, wherein the at least one bolt passing through the vertical joining plate and the first vertical member comprises a one-sided bolt.

4. The apparatus of claim 1, wherein the at least one bolt passing through the vertical joining plate and the second vertical member comprises a one-sided bolt.

5. A reinforced vertical multi-sided monopole tower, comprising:

a monopole-type tower wall having a solid outer wall formed into a plurality of sides;

the tower wall having an outer surface and an inner surface;

a plurality of first vertical reinforcing members bolted by a first plurality of one-sided bolts to two or more of the plurality of sides of the tower wall, wherein each of the first vertical reinforcing members comprises a first longitudinal side, a second longitudinal side and a first end surface between the first and second longitudinal sides such that the first longitudinal side of each of the first reinforcing members overlays a portion of the outer surface of at least one side of the plurality sides of the tower wall;

a plurality of second vertical reinforcing members, each of the second vertical reinforcing members comprises a first longitudinal side, a second longitudinal side, and a second end surface between the first and second longitudinal sides, each of the second vertical reinforcing members bolted by a second plurality of one-sided bolts to two or more of the plurality of sides of the outer surface of the tower wall such that the first side of each of the second reinforcing members overlays a portion of the at least one side of the plurality of sides of tower wall, wherein each of the second vertical reinforcing members vertically align with at least one of the first vertical reinforcing members such that the second end surface of each of the second vertical reinforcing members is substantially aligned with and adjacent to one of the first end surfaces of a first vertical reinforcing members;

a vertical joining plate bolted using one or more one-sided bolts to the second longitudinal side of each of the first vertical reinforcing members or the second longitudinal side of each of the second vertical reinforcing members, such that at least one vertical joining plate overlays the first and second end surfaces; and at least one of the one-sided bolts passes through the vertical joining plate and either the first vertical reinforcing member or the second vertical reinforcing member and into at least one side of the tower wall.

6. The reinforcing apparatus of claim 1 wherein the first abutting surface of the first reinforcing member and the second abutting surface of the second reinforcing member are positioned such that they may abut as a result of thermal expansion.

7. The reinforcing apparatus of claim 1 wherein the first abutting surface of the first reinforcing member and the second abutting surface of the second reinforcing member are abutting when installed.

8. The reinforcing apparatus of claim 5 wherein the first abutting surfaces of the first reinforcing members and the second abutting surfaces of the second reinforcing member are positioned such that they may abut as a result of thermal expansion.

9. The reinforcing apparatus of claim 5 wherein the first abutting surface of the first reinforcing member and the second abutting surface of the second reinforcing member are abutting when installed.

10. A reinforcing system for a monopole tower comprising:

a vertical monopole tower comprising a tower wall having an inner surface and an outer surface;

a first vertical reinforcing member having a first longitudinal side, a second longitudinal side and a first end surface between the first and second longitudinal sides, the first vertical reinforcing member bolted by a plurality of one-sided bolts to the vertical monopole tower, wherein the first longitudinal side of the first vertical reinforcing member overlays and is attached to a portion of the outer surface of the tower wall;

a second vertical reinforcing member having a first longitudinal side, a second longitudinal side, and a second end surface between the first and second longitudinal sides, the second vertical reinforcing member bolted by a plurality of one-sided bolts to the vertical monopole tower, wherein the first longitudinal surface of the second reinforcing member overlays and is attached to a portion of the outer surface of the vertical monopole and wherein the second vertical reinforcing member is substantially vertically aligned with the first vertical reinforcing member;

a vertical joining plate having a first longitudinal side and a second longitudinal side, wherein the first longitudinal side of the vertical joining plate overlays and is attached to portions of the second longitudinal sides of the first and second reinforcing members, wherein the vertical joining plate is bolted using one or more one-sided bolts to the first vertical reinforcing member or the second vertical reinforcing member and the tower wall.

11. The apparatus of claim 10, wherein the first vertical reinforcing member is coupled to a base portion of the multi-sided monopole tower.

12. The apparatus of claim 10, wherein the first vertical reinforcing member further comprises a second end surface coupled to a base portion of the multi-sided monopole tower wherein the second end surface of the first vertical reinforcing member is between the first and second longitudinal sides and longitudinally opposite the first end surface of the first vertical reinforcing member.

13. A reinforcing system for a monopole tower comprising:

a vertical monopole tower comprising a tower wall having an inner surface and an outer surface;

a first reinforcing apparatus and a second reinforcing apparatus, each comprising:

a first vertical reinforcing member having a first longitudinal side, a second longitudinal side and a first end surface between the first and second longitudinal sides, the first vertical reinforcing member bolted by a plurality of one-sided bolts to the vertical monopole tower, wherein the first longitudinal side of the first vertical reinforcing member overlays and is attached to the outer surface of the tower wall;

a second vertical reinforcing member having a first longitudinal side, a second longitudinal side, and a second end surface between the first and second longitudinal sides, the second vertical reinforcing member bolted by a plurality of one-sided bolts to the vertical monopole tower, wherein the first longitudinal surface of the second reinforcing member overlays and is attached to the outer surface of the vertical monopole and wherein the second vertical reinforcing member is substantially vertically aligned with the first vertical reinforcing member; and a vertical joining plate having a first longitudinal side and a second longitudinal side, wherein the first longitudinal side of the vertical joining plate overlays and is attached to the second longitudinal sides of the first and second reinforcing members, wherein the vertical joining plate is bolted using one or more one-sided bolts to the first vertical reinforcing member or the second vertical reinforcing member and the tower wall.

14. The reinforcing system of claim 13 wherein the first and second reinforcing apparatuses are vertically aligned.

15. The reinforcing system of claim 13 wherein the first and second reinforcing apparatuses are attached to the same side of the tower wall.

16. The reinforcing system of claim 13 wherein the first and second reinforcing apparatuses are attached to different sides of the tower wall.

17. The reinforcing system of claim 13 wherein the first and second reinforcing apparatuses are attached to different sides of the tower walls and are approximately 120 degrees apart.

18. The reinforcing system of claim 13 wherein the first and second reinforcing apparatuses are attached to different sides of the tower walls and are approximately 90 degrees apart.

19. A reinforced vertical multi-sided monopole tower, comprising:

a monopole-type tower wall having a solid outer wall formed into at least one side, the tower wall having an outer surface and an inner surface;

a first vertical reinforcing member having a first longitudinal side, a second longitudinal side and a first end surface between the first and second longitudinal sides, the first vertical reinforcing member bolted by a plurality of one-sided bolts to at least one side of the multisided monopole tower, wherein the first longitudinal side of the first vertical reinforcing member overlays and is attached to the outer surface of the tower wall;

a second vertical reinforcing member having a first longitudinal side, a second longitudinal side, a first end surface between the first and second longitudinal sides and a second end surface between the first and second longitudinal sides and longitudinally opposite the first end surface, the second vertical reinforcing member bolted by a plurality of one-sided bolts to the at least one side of the multi-sided monopole tower, wherein the first longitudinal side of the second vertical reinforcing member overlays and is attached to the outer surface of the tower wall, wherein the second vertical reinforcing member is vertically aligned with the first vertical reinforcing member and the first end surface of the first vertical reinforcing member and the second end surface of the second vertical reinforcing member are positioned adjacent to each other and form a first junction;

a first joining plate, wherein the first joining plate extends between and is attached to the first and second vertical reinforcing members;

at least one of the one-sided bolts passes through the first joining plate and either the first vertical reinforcing member and into the at least one side of the multi-sided monopole tower or the at least one of the one-sided bolts passes through the first joining plate and the second vertical reinforcing member and into the at least one side of the multi-sided monopole tower;

a third vertical reinforcing member having a first longitudinal side, a second longitudinal side, and a first end surface between the first and second longitudinal sides and a second end surface between the first and second longitudinal sides and longitudinally opposite the first end surface, the third vertical reinforcing member bolted by a plurality of one-sided bolts to the at least one side of the multi-sided monopole tower, wherein the first longitudinal side of the third vertical reinforcing member overlays and is attached to the outer surface of the tower wall, wherein the third vertical reinforcing member is vertically aligned with the first and second vertical reinforcing members and the first end surface of the second vertical reinforcing member and the second end surface of the third vertical reinforcing member are positioned adjacent to each other and form a second junction;

a second joining plate, wherein the second joining plate extends between and is attached to the first and second reinforcing members; and at least one of the one-sided bolts passes through the second joining plate and either the second vertical reinforcing member and into the at least one side of the multi-sided monopole tower or the at least one of the one-sided bolts passes through the second joining plate and the third vertical reinforcing member and into the at least one side of the multi-sided monopole tower.

* * * * *

UNITED STATES PATENT AND TRADEMARK OFFICE

CERTIFICATE OF CORRECTION

PATENT NO. : 8,156,712 B2
APPLICATION NO. : 13/228355
DATED : April 17, 2012
INVENTOR(S) : Michael J. Kopshever, Sr.

It is certified that error appears in the above-identified patent and that said Letters Patent is hereby corrected as shown below:

In Claim 5, Column 6, Line 17, delete "plurality sides" and insert -- plurality of sides --, therefor.

In Claim 11, Column 7, Line 27, delete "apparatus of" and insert -- reinforcing system of --, therefor.

In Claim 12, Column 7, Line 30, delete "apparatus of" and insert -- reinforcing system of --, therefor.

Signed and Sealed this
Fourteenth Day of August, 2012

David J. Kappos

David J. Kappos
*Director of the United States Patent and Trademark Office*